US007155027B2

(12) United States Patent
Lee

(10) Patent No.: US 7,155,027 B2
(45) Date of Patent: Dec. 26, 2006

(54) HOME THEATER IN A BOX SPEAKER MOUNT WITH INTEGRATED MOUNTING TOOL

(75) Inventor: Noel Lee, Daly City, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 602 days.

(21) Appl. No.: 10/119,186

(22) Filed: Apr. 8, 2002

(65) Prior Publication Data

US 2003/0190050 A1 Oct. 9, 2003

(51) Int. Cl.
*H04R 1/02* (2006.01)
*A47B 81/06* (2006.01)

(52) U.S. Cl. ..... 381/390; 181/199; 381/386

(58) Field of Classification Search ..... 381/386, 381/387, 388, 390, 395; 181/199; 248/288.51
See application file for complete search history.

(56) References Cited

U.S. PATENT DOCUMENTS 5,473,700 A * 12/1995 Fenner, Jr. ..... 381/336
5,867,583 A * 2/1999 Hazelwood et al. ..... 381/395
2003/0142422 A1* 7/2003 Spitzer et al. ..... 359/842

* cited by examiner

*Primary Examiner*—Sinh Tran
*Assistant Examiner*—Brian Ensey
(74) *Attorney, Agent, or Firm*—LaRiviere, Grubman & Payne, LLP

(57) ABSTRACT

The invention discloses a single anchor screw speaker mount 10 with substantially tool free installation where the speaker mount 10 itself can be utilized as the mounting tool. Utilizing a surface specific screw 52, speaker mount 10 is affixed to surface 15 by hand rotation until flush with mount plate 20 then adjusted for speaker placement by rotation around the anchor screw hexagonal head receptacle 40 and ball joint component 60.

8 Claims, 3 Drawing Sheets

HOME THEATER IN A BOX SPEAKER MOUNT WITH INTEGRATED MOUNTING TOOL

TECHNICAL FIELD

The present invention relates generally to the mounting of items to surfaces. The present invention relates specifically to the mounting of electronic loudspeakers to indoor or outdoor surfaces.

BACKGROUND ART

Speaker wall mounting brackets commonly require the use of separate tools for installation, as well as the selection of a surface specific anchor screw as well as support elements. When attaching speaker wall mounting brackets, the bracket usually employs screws appropriate for the wall surface to be mounted upon and requires separate tools for installing the wall specific mounting screw. Moreover, the mounting bracket face can be quite large, making manipulation of the bracket unwieldy. Installation of the mounting bracket is often a cumbersome process involving the tracing of bracket location, drilling followed by attaching the anchor screw or screws. As home theater audio systems become more mainstream, there is a need to simplify the loudspeaker mounting process for the average consumer.

DISCLOSURE OF INVENTION

Many speaker wall mounting brackets come close to being near mirror images at each end, with the wall mounting portion and speaker mounting portion each having a metallic rectangular plate with holes for mounting. The present invention optimizes the wall mounting end for surface mounting, while the speaker mounting end has a different conformation which is much more suited to speaker mounting and adjustment than for use as a wall mount. The invention includes an anchor screw with coarse thread which passes through an anchor plate, star wheel washer and cover. Employing an octagonal screw receptacle and a split housing ending in a socket joint, the speaker mount can even be mounted by hand without resorting to drills or other mounting tools. Also, by having a reduced number of components, the likelihood of distortion problems from simple harmonic frequency buildup can be reduced.

BEST MODE OF CARRYING OUT THE INVENTION

Figure 1:
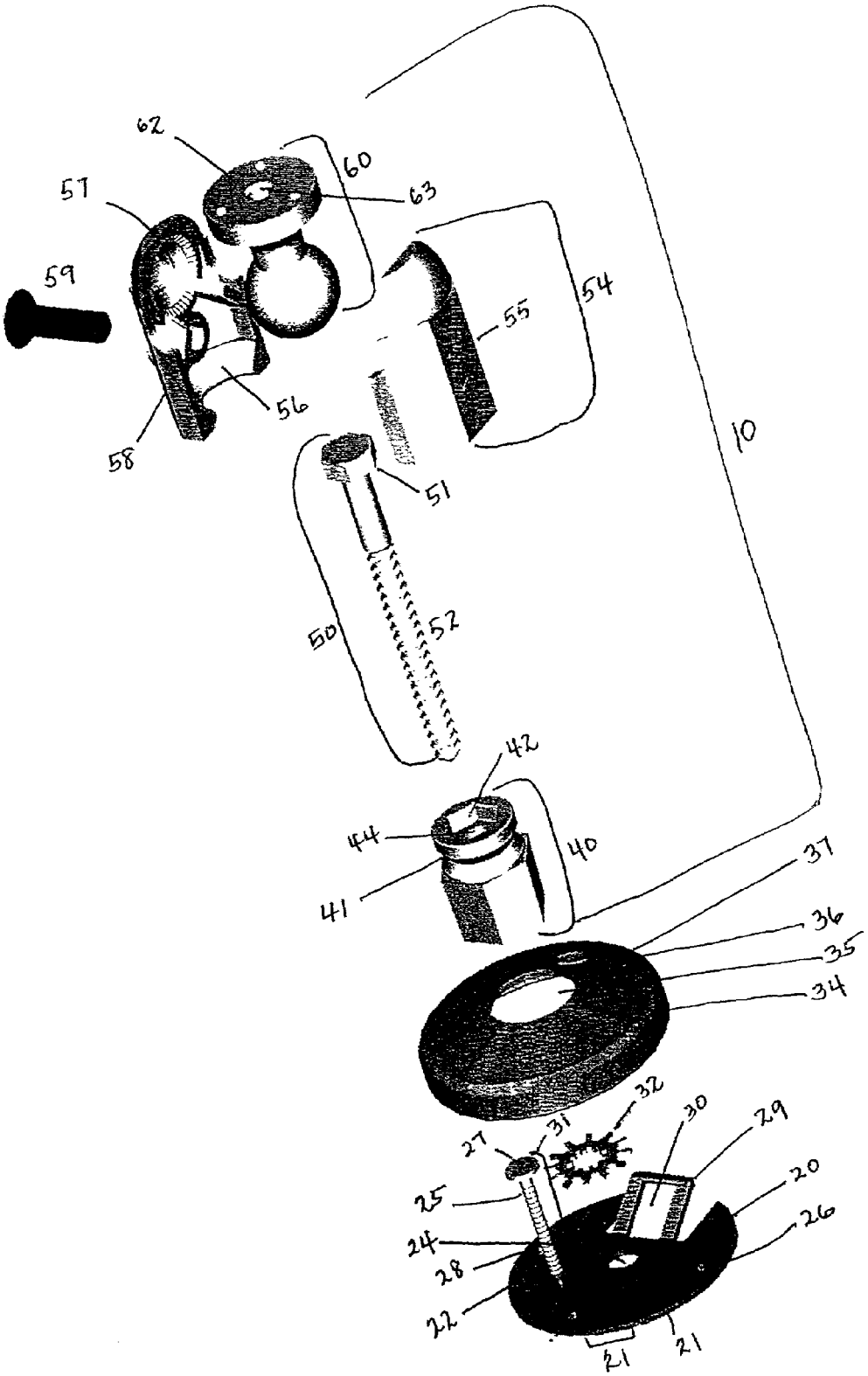
FIG. 1 Exploded view of mount.

Starting from the mounted end and working towards the speaker end of the mount 10, the best mode of the invention is represented in FIG. 1 and as described below. Mount 10 attaches to the selected surface 15 once the mounting plate 20 has been positioned for speaker placement. Mounting plate 20 is a substantially circular metal piece with two orientation holes 26, 28, an anchor screw hole in the center 24 and a raised speaker cable flange 29 for proper orientation of speaker cable. Mounting plate 20 has a wall side 21 which is smooth for uniform mounting of the plate against the selected surface, and a mount side 22 of mounting plate has a raised speaker cable flange portion 29. Anchor screw hole 24 is located in the center of the mounting plate and of a diameter large enough to allow the threaded portion of an anchor screw to pass, but of a smaller diameter than an anchor screw hex head.

First nail orientation hole 26 is of a large enough diameter to allow the orientation nail shaft 25 to pass through, but small enough to prevent the orientation nail head 27 from passing through as well. Second nail orientation hole 28 also is of a large enough diameter to allow the orientation nail shaft to pass through, but small enough to prevent the orientation nail head from passing through as well. Ideally, the second nail orientation hole is located on the same axis as the first nail orientation hole and the anchor screw hole. Orientating nail 31 is optional and the invention can be practiced without employing any orientation nails 31. Mounting plate speaker cable flange 29 is raised at an angle from the mounting plate and has an enclosed hollow space for routing speaker cable 30. Mounting plate speaker cable flange 29 has an angled end to further guide speaker cable.

Mounting plate speaker cable flange cable hole 30 is surrounded by mounting plate speaker cable flange 29, and is of a sufficient diameter so as to allow most common types of speaker cable to pass through. Orienting nail 31 is of sufficient diameter to pass through either nail orienting hole 26, 28 yet possess a head 27 substantially wide enough to anchor the mounting plate into place.

When speaker mount 10 is mounted on mount plate 20, mounting tension will be adjusted by the rotational compression of the lock washer 32 in combination with the hex head anchor lag screw 50. Mount plate 20 will also be cosmetically concealed by the mounting plate cover 34 which can be made out of synthetic materials such as plastic or natural materials such as rubber. Mounting plate cover 34 should be oriented over mount plate 20 so that the mounting plate cover anchor screw hole 35 is positioned over anchor screw hole 24 and so that the mounting plate cover top flange hole 36 and mounting plate cover side flange hole 37 are positioned over speaker cable flange 29.

Figure 3:
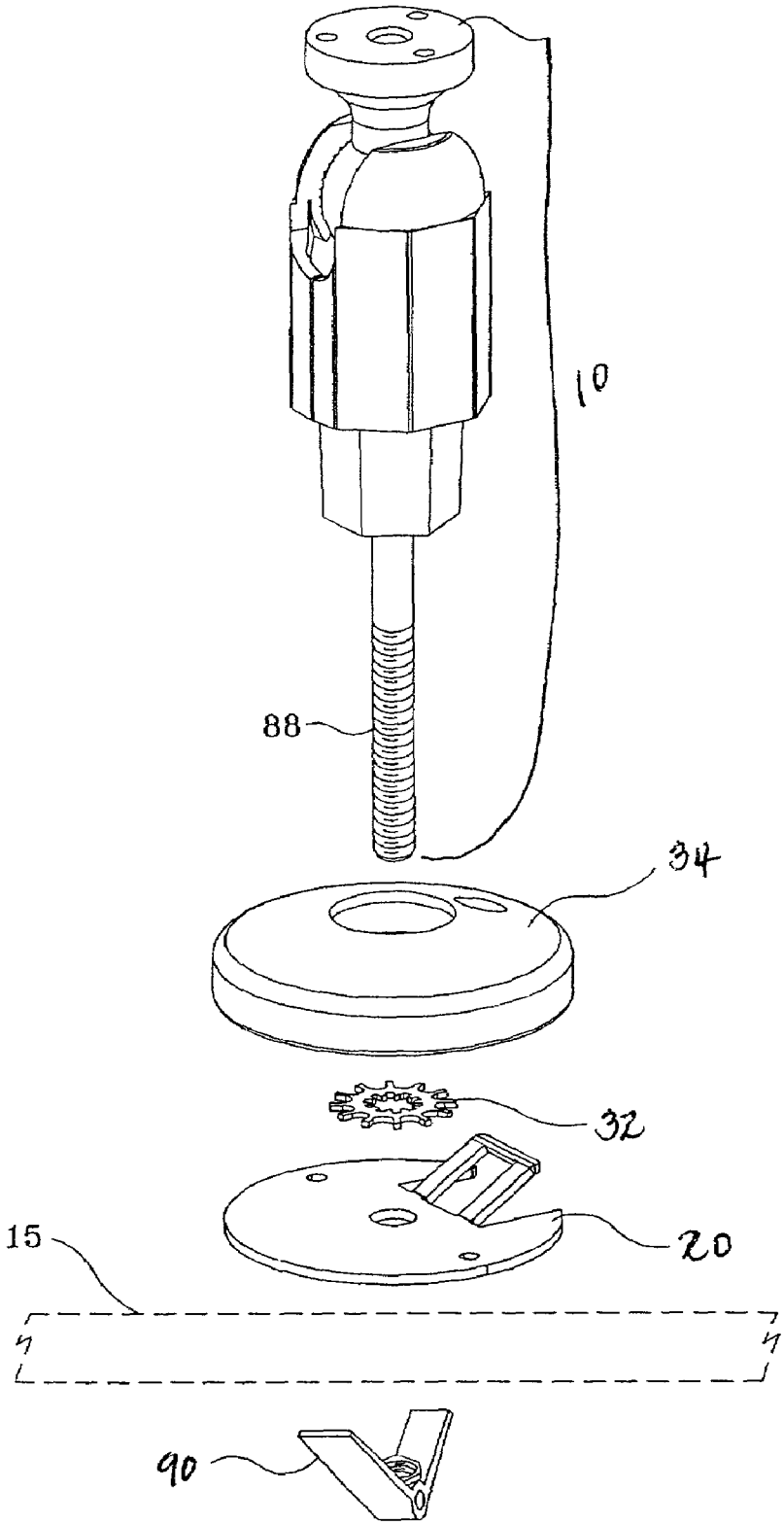
FIG. 3 Assembled anchor bolt mount variant prior to mounting.

Hex head anchor lag screw 50 is surface 15 specific, and in one preferred embodiment has coarse thread 52. As surface 15 composition varies, hex head anchor screw can vary as well to include associated adaptors for drywall and other types of materials. FIG. 3 depicts an anchor bolt variant with an anchor bolt 90 acting in conjunction with a properly threaded screw 88.

Returning to FIG. 1, the anchoring of speaker mount 10 to surface 15 takes place by the combination of hex head anchor lag screw 50 with the anchor screw hexagonal head receptacle 40. Receptacle 40 has a hexagonal receptacle anchor screw head indentation 42 for receiving the anchor screw hexagonal head 51. Anchor screw thread 52 passes through the hexagonal receptacle non-threaded anchor screw hole 44 on its way to anchoring in surface 15. Anchor screw hexagonal head receptacle 40 terminates with hexagonal receptacle swivel lip 41 for attachment to the ball joint socket 54.

Ball joint socket 54 serves to connect with anchor screw hexagonal head receptacle 40 on one end and to connect with the ball joint component 60 on the other. Ball joint component 60 is commonly made out of 12% glass filled nylon but could be made out of any suitable material. Ball joint socket 54 is made up of two halves, the ball joint socket half with threaded receptacle 55 and the ball joint socket half with non-threaded hole 58. Each half 55 and 58 is a painted metal article which has one half of the outside surface octagonal external configuration. Ball joint socket 54 attaches to the anchor screw hexagonal head receptacle 40 at the ball joint socket groove 56 and to ball joint component 60 at the ball joint socket knurled pocket 57. The two halves 55 and 58 are held together with the ball joint flat head socket cap screw 59. With ball joint component 60 inserted in ball joint socket knurled pocket 57, speaker mount 10 ends at the ball joint mounting plate 62, with the threaded ball joint mounting plate screw hole 63 ready to receive a speaker mounting post with equivalent thread situated to facilitate locking of ball joint component 60.

Figure 2:
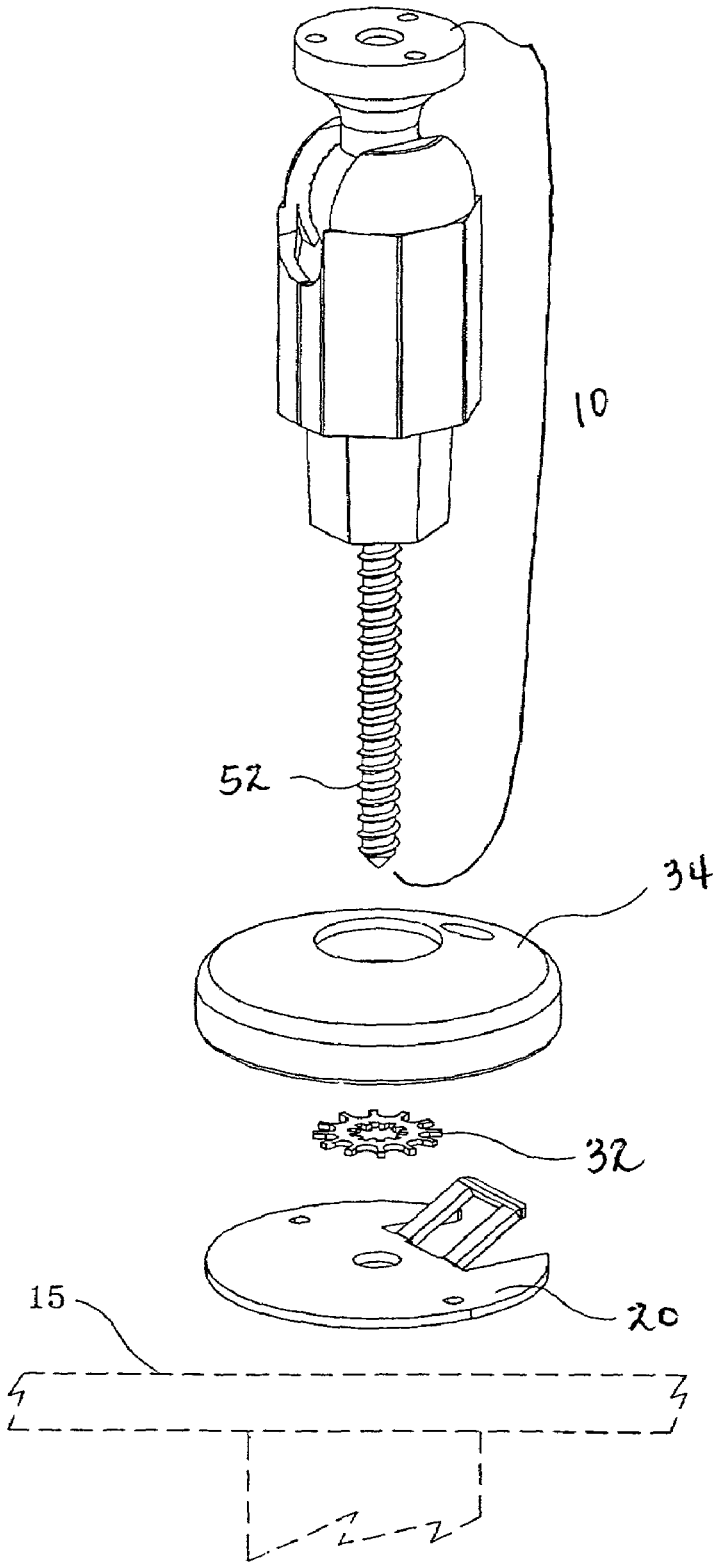
FIG. 2 Assembled mount prior to wall mounting.

The assembled speaker mount 1 in FIG. 2 makes use of ball joint component 60 as well as anchor screw hexagonal receptacle 40 to work as a mounting tool to drive in hex head anchor lag screw 50 by the rotation of speaker mount 1. When speaker mount 1 is assembled, hex head anchor lag screw 50 is oriented through hexagonal receptacle non-threaded anchor screw hole 44 and anchor screw hexagonal head 51 is seated in hexagonal receptacle anchor screw head indentation 42.

Speaker mount 10 shape can be adjusted by the loosening of ball joint flat head socket cap screw 59 in ball joint mounting plate screw hole 63 so that ball joint component 60 can swivel to be positioned more comfortably to the hand during installation and subsequently adjusted for speaker mounting. To permit mounting of speaker mount 10, ball joint flat head socket cap screw 59 must be retightened to prevent unwanted rotation of ball joint socket 54 around anchor screw hexagonal receptacle 40.

Once a suitable position for positioning speaker mount 10 on surface 15 has been selected, the installation of speaker mount 10 begins with affixing the wall side 21 of the mounting plate 20 to surface 15 the mount will be affixed to. Mounting plate speaker cable flange 29 may be oriented as desired. Since mounting.plate speaker cable flange cable hole 30 is provided for routing of speaker cable wire, this benefit should be taken into account when positioning mounting plate 20. Mounting plate 20 is affixed to surface 15 by driving orienting nail 31 from the mount side of mounting plate 22 through first nail orientation hole 26, followed by driving another orienting nail 31 through second orientation hole 28. Once mounting plate 20 has been affixed to surface 15, mounting plate cover 34 is positioned over mounting plate 20 with the mounting plate cover anchor screw hole 35 automatically positioned over anchor screw hole 24 and mounting plate cover flange top hole 36 and mounting plate cover side flange hole 37 positioned over mounting plate speaker cable flange 29.

To affix speaker mount 10, hex head anchor lag screw 50 with surface specific characteristics is used. In the case of the illustrated example, hex head anchor lag screw 50 has coarse thread 52. Assembled speaker mount 10 functions as an installation tool by transferring rotational force on anchor screw hexagonal head 51 when it is recessed in anchor screw hexagonal receptacle 40 in speaker mount 10 as assembled. Hex head anchor lag screw 50 is aligned with anchor screw hole 24 and speaker mount 10 is rotated until anchor screw hexagonal receptacle 40 is nearly flush with the wall. The orientation of ball joint mounting plate 62 may then be achieved by loosening ball joint flat head socket cap screw 59 so that ball joint socket 54 made up of ball joint socket half with threaded receptacle 55 and ball joint socket half with non-threaded hole 58 can swivel about hexagonal receptacle swivel lip 41 and ball joint socket groove 56. While loosened, ball joint component 60 can also be repositioned within ball joint socket knurled pocket 57. Once positioned as desired and ball joint flat head socket cap screw 59 has been retightened, speaker mount 10 is ready to receive the speaker on the ball joint mounting plate 62.

Another variant of the same invention includes use of an anchor bolt 90 in conjunction with anchor screw 88 in place of hex head anchor lag screw 50. In this embodiment the device is suited for applications where an anchor bolt would be more suitable. When used in conjunction with hex head anchor lag screw 50, an initial surface hole can be made with hex head anchor screw 50 followed by replacement of anchor screw 50 with anchor screw 88 followed by anchor bolt 90 installation.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims, in which reference to an element in the singular is not intended to mean "one and only one" unless explicitly so stated, but rather "one or more". The inventions illustratively disclosed herein may be practiced without any element which is not specifically disclosed herein.

What is claimed is:

1. A method of mounting an audio loudspeaker component to a flat surface using the mount itself as the primary mounting tool comprising the steps of:

fastening a mounting plate at a desired location site on a surface, positioning a speaker mount into an attachment configuration, rotating said mount by hand in said attachment configuration until said mount has become securely fastened against said mounting plate, and repositioning said mount into a desired loudspeaker attachment configuration.

2. A method of mounting an audio loudspeaker component to a flat surface using the mount itself as the primary mounting tool comprising the steps of:

fastening a mounting plate at a desired location site on a surface, positioning a speaker mount into an attachment configuration, rotating said mount by hand in said attachment configuration until said mount has become securely fastened against said mounting plate, fixing by locking said mount to prevent subsequent loosening of said mount, and repositioning said mount into a desired loudspeaker attachment configuration.

3. A device for mounting an audio loudspeaker on a surface comprising a mount with a single anchor screw for surface mounting, said mount incorporating rotation means for hand attachment to said surface, a means for speaker mounting at the end opposite to the single anchor screw, and said mount attaches to said surface through a mounting plate, a mounting plate cover and a lock washer to secure said mount to said mounting plate.

4. A device as in claim 3 where said mounting plate comprises a speaker cable guide flange with hole to permit routing of a speaker cable.

5. A device as in claim 4 where said means for speaker mounting incorporates a ball joint for speaker orientation.

6. A device as in claim 5 wherein said mount includes a second means for speaker orientation incorporating an indentation and groove for 360 degree rotation around said anchor screw.

7. A device as in claim 6 wherein said ball joint is held by a knurled surface.

8. A device for mounting an audio loudspeaker on a surface comprising an anchor screw for surface attachment with surface screw capable of being attached to a surface by rotation, said anchor screw surrounded by an anchor screw receptacle for transferring rotational force to said anchor screw, said anchor screw receptacle having a flat wall end and an indented swivel lip end, said anchor screw receptacle indented swivel lip end capable of being clasped by a ball joint socket, said ball joint socket having a grooved end and a knurled pocket end, said knurled pocket end capable of receiving a ball joint component, and said ball joint component having a ball joint end and a speaker mounting end.

* * * * *